US010323469B2

(12) United States Patent
Martinez et al.

(10) Patent No.: US 10,323,469 B2
(45) Date of Patent: Jun. 18, 2019

(54) COLLET DEVICE WITH AN ADJUSTABLE SNAP VALUE

(71) Applicant: Halliburton Energy Services, Inc., Houston, TX (US)

(72) Inventors: Samuel Martinez, Cedar Hill, TX (US); Eddie Eddieberto Perez, McKinney, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 19 days.

(21) Appl. No.: 15/542,843

(22) PCT Filed: Sep. 15, 2016

(86) PCT No.: PCT/US2016/051886

§ 371 (c)(1),
(2) Date: Jul. 11, 2017

(87) PCT Pub. No.: WO2018/052422

PCT Pub. Date: Mar. 22, 2018

(65) Prior Publication Data

US 2018/0266191 A1 Sep. 20, 2018

(51) Int. Cl.
*E21B 23/02* (2006.01)
*E21B 17/046* (2006.01)
(Continued)

(52) U.S. Cl.
CPC ..... *E21B 17/046* (2013.01); *E21B 23/02* (2013.01); *E21B 31/18* (2013.01); *E21B 31/20* (2013.01)

(58) Field of Classification Search
CPC ..... E21B 23/02; E21B 17/046; E21B 31/18; E21B 31/20
See application file for complete search history.

(56) References Cited

U.S. PATENT DOCUMENTS 528,051 A * 10/1894 Whalen ..... F16L 33/222 285/243
2,205,347 A * 6/1940 Darling ..... F16L 33/222 285/243
(Continued)

FOREIGN PATENT DOCUMENTS

| | | |
|---|---|---|
| WO | 2015023282 | 2/2015 |
| WO | 2016043702 | 3/2016 |
| WO | 2016077519 | 5/2016 |

OTHER PUBLICATIONS

Hunting , "Heavy Duty Disconnect", Retrieved from Hunting Energy Services on Mar. 8, 2016: http://www.hunting-intl.com/well-intervention-equipment/thru-tubing-technology/disconnects/heavy-duty-disconnect, 1 page.
(Continued)

*Primary Examiner* — Giovanna C Wright
(74) *Attorney, Agent, or Firm* — Kilpatrick Townsend and Stockton LLP

(57) ABSTRACT

A collet device with an adjustable snap value can have a tubular body and beams. The tubular body can have a main body, an inner member in an inner area of the main body, and an outer member in an area external to the main body. The inner member and the outer member can each be axially moveable relative to the main body. The beams can be axially coupled to the main body, and a portion of the beams may extend axially from the tubular body. A length of the portion of the beams that extend axially from the tubular body can be adjustable by moving the inner member or the outer member for changing a snap value of the collet. The snap value corresponding to a magnitude of force exertable by the beams in a direction of a mating body that can be positioned radially adjacent to the beams.

20 Claims, 8 Drawing Sheets

(51) Int. Cl.
*E21B 31/18* (2006.01)
*E21B 31/20* (2006.01)

(56) References Cited

U.S. PATENT DOCUMENTS

| | | | | | |
|---|---|---|---|---|---|
| 3,574,385 | A * | 4/1971 | Pignataro, Jr. | B25B 9/00 | 294/86.22 |
| 4,332,410 | A | 6/1982 | Baker | | |
| 4,508,167 | A | 4/1985 | Weinberg et al. | | |
| 4,722,390 | A * | 2/1988 | Smith, Jr. | E21B 23/02 | 166/115 |
| 5,029,646 | A | 7/1991 | Blizzard, Jr. | | |
| 5,363,921 | A * | 11/1994 | Mendez | E21B 23/00 | 166/123 |
| 5,794,694 | A | 8/1998 | Smith, Jr. | | |
| 6,209,886 | B1 | 4/2001 | Estes et al. | | |
| 6,464,006 | B2 | 10/2002 | Womble | | |
| 6,494,257 | B2 | 12/2002 | Bartlett et al. | | |
| 6,511,099 | B2 | 1/2003 | Bartholomä et al. | | |
| 7,040,407 | B2 | 5/2006 | Jennings et al. | | |
| 7,635,379 | B2 | 12/2009 | Callahan et al. | | |
| 8,256,802 | B2 | 9/2012 | Werth | | |
| 8,893,787 | B2 | 11/2014 | Tips et al. | | |
| 2007/0243499 | A1 | 10/2007 | Bowen | | |
| 2013/0186646 | A1 | 7/2013 | Xu | | |
| 2013/0299193 | A1 * | 11/2013 | Duong | E21B 33/04 | 166/382 |
| 2014/0209323 | A1 | 7/2014 | Pisetskiy et al. | | |
| 2014/0311757 | A1 * | 10/2014 | Hallundbæk | E21B 23/04 | 166/383 |
| 2015/0060049 | A1 | 3/2015 | Steele et al. | | |
| 2015/0075815 | A1 | 3/2015 | O'brien et al. | | |
| 2015/0204162 | A1 * | 7/2015 | Gay | E21B 34/06 | 166/373 |
| 2015/0368983 | A1 | 12/2015 | Perez et al. | | |

OTHER PUBLICATIONS

Lee et al., "Lessons Learned from Highly Deviated Openhole Completions in Two HP/HT Retrograde Gas-Condensate Fields Using Expandable Liner Hangers, External-Sleeve Inflatable Packer Collars, and Swellable Packers for Zonal Isolation", presented at the IADS/SPE Assia Pacific Drilling Technology Conference and Exhibit in Jakarta, Indonesia, SPE 114789, Aug. 25-27, 2008.

International Patent Application No. PCT/US2016/051886 , "International Search Report and Written Opinion", dated Jun. 15, 2017, 10 pages.

Schlumberger , "Model A Hydro-Trip Sub", Retrieved from Schlumberger on Mar. 8, 3026 at http://www.slb.com/~/media/Files/completions/product_sheets/accessories/modela_hydro_trip_sub.pdf, 2008, 1 page.

* cited by examiner

COLLET DEVICE WITH AN ADJUSTABLE SNAP VALUE

TECHNICAL FIELD

The present disclosure relates generally to adjusting a force for coupling two devices, and more particularly (although not necessarily exclusively), to a collet device with an adjustable snap value.

BACKGROUND

A collet device can include beams that extend axially from a body of the collet device. The beams can be positioned radially adjacent to a mating device for gripping the mating device and coupling the collet device to the mating device. The beams can exert a force for gripping the mating device in response to a bend applied to the beams in positioning the beams radially adjacent to the mating device. In some examples, the beams are positioned around a shaft for gripping an outer surface of the shaft. The beams may exert an inwardly radial force if the outer diameter of the shaft is larger than an inner diameter of the beams. The magnitude of the force that can be exerted by the beams in a direction of the mating device can be referred to as a snap value.

DETAILED DESCRIPTION

Figure 1:
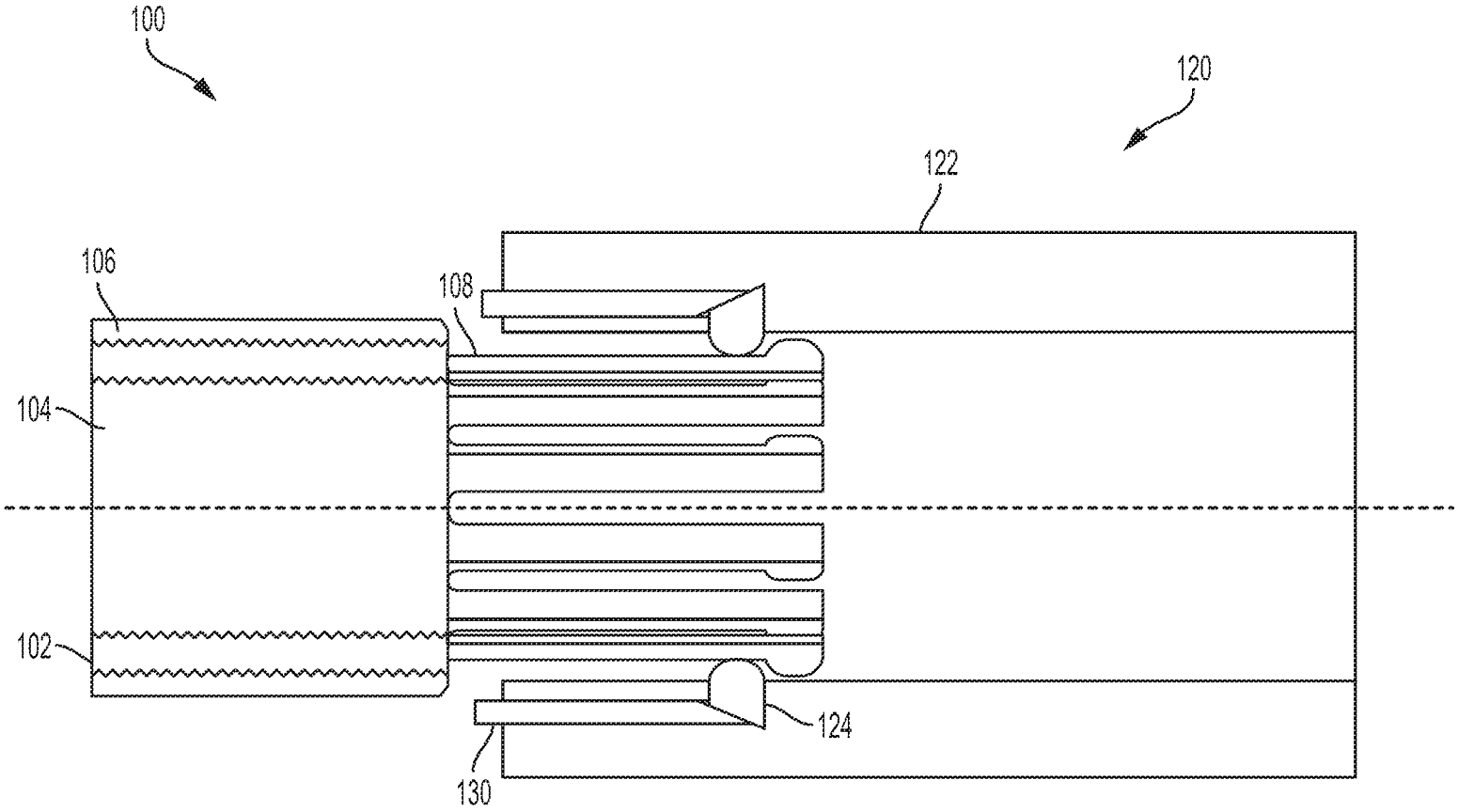
FIG. 1 is a cross-sectional diagram of an example of a collet device coupled to a mating device according to one aspect of the present disclosure.

Certain aspects and features relate to a collet device with an adjustable snap value. The snap value can correspond to a magnitude of force that can be exerted by a collet device for coupling the collet device with a mating device. A collet device can include a tubular body and beams. A portion of the beams can extend axially from the tubular body and the beams may bend when positioned in or around a mating device. The beams can exert a force in a direction of the mating device that is proportional in magnitude to a force used to bend the beams. Adjusting a length of the beams can change the amount of force required to bend the beams and can change the snap value of the collet device. The amount the beams must bend to be positioned in or around the mating device can also be changed to adjust the snap value of the collet device.

A collet device can include a tubular body having a main body, an inner member, and an outer member. The beams can be coupled to the main body and the beams can extend axially from the tubular body. The inner member and the outer member can move axially relative to the main body for changing the length of a portion of the beams that extends from the tubular body. The portion of the beams that extends from the tubular body can bend to be positioned in or around a mating device. For example, the beams may be positioned in an inner area of a mating device for gripping an inner surface of the mating device. The inner diameter of the mating device may be smaller than the outer diameter of the portion of the beams that extends from the tubular body. Positioning the beams in the inner area may cause the portion of the beams that extends from the tubular body to bend inward radially. An outwardly radial force can be exerted by the portion of the beams extending from the tubular body for gripping the inner surface of the mating device in response to the portion of the beams extending from the tubular body being bent inward.

Changing the length of the portion of the beams that extends from the tubular body can change the magnitude of force used to bend the portion of the breams and adjust the snap value of the collet device. A beam with a longer portion extending from the tubular body can be more easily bent than a beam with a shorter portion extending from the tubular body. In some examples, the less force used to bend the beams the lower the snap value.

Some applications of a collet require a precise snap value. A precise snap value for a collet device can be obtained through trial and error by manufacturing collet devices of different shapes and sizes. Additionally, material can be removed from a manufactured collet device to adjust the snap value. For example, material can be removed from the end of the beams to shorten the beams or material can be removed from an outer surface of the beams to reduce the outer diameter of the beams. In some aspects, a snap value of a collet device can be adjusted by changing a length of a portion of the beams that extends from a tubular body. Changing the length of the portion of the beams that extends from the tubular body can be performed after manufacturing without adding or removing material from the collet device.

In some examples, a snap value of a collet device can be calibrated post manufacturing to environmental conditions. The collet device can be used with downhole tools that require a narrow snap value range including various indicating tools.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

FIG. 1 is a cross-sectional diagram of an example of a collet device 100 coupled to a mating device 120. The collet device 100 can have a tubular body that includes a main body 102, inner member 104, and an outer member 106. Beams 108 can be coupled to the main body 102 such that a portion of the beams 108 extends, from the tubular body. The inner member 104 and the outer member 106 can move axially to change a length of the portion of the beams 108 that extends from the tubular body. The mating device 120 can include a mating body 122 with a locking member 124 and a wedge 130. The locking member 124 can extend from the inner surface of the mating body 122 and wedge 130 can move axially to change an amount that that locking member 124 extends from the mating body 122. The collet device 100 can have a snap value corresponding to a magnitude of force exerted by the beams 108 in the direction of the mating device 120. The snap value can be adjusted by changing a length of the portion of the beams 108 that extends from the tubular body or changing an amount that the locking member 124 extends from the mating body 122.

The inner member 104 can be radially adjacent to an inner surface of the main body 102. The outer member 106 can be radially adjacent to an outer surface of the main body 102. The inner member 104 and the outer member 106 can be threadably coupled to the main body 102 and the inner member 104 and the outer member 106 can move axially relative to the main body 102. The inner member 104 and the outer member 106 can be positioned axially to encompass a section of the beams 108 such that the section of the beams 108 is within the tubular body. The portion of the beams 108 that extends from the tubular body can bend at a seam between the beams 108 and the tubular body. The longer the portion of the beams 108 that extends from the tubular body the less force that is required to bend the portion of the beams 108. The snap value can be based on the magnitude of force required to bend the portion of the beams 108. The inner member 104 and outer member 106 are illustrated in FIG. 1 as not encompassing any section of the beams 108 such that the length of the portion of the beams 108 extending from the tubular body is the length of the beams 108 such that the snap value can be at its lowest for the collet device 100.

The wedge 130 can be positioned between an inner surface and an outer surface of mating body 122. The wedge 130 can have a sloped edge that contacts a substantially parallel sloped edge of a locking member 124. The wedge can move axially to adjust the amount that the locking member 124 extends from the inner surface of the mating body 122. In FIG. 1, the wedge 130 can move to the right to cause the locking member 124 to extend further from the surface of the mating body 122. The wedge can also move to the left to allow the locking member 124 to extend less from the inner surface of the mating body 122.

The locking member 124 can form the smallest inner diameter of the mating body 122 and can contact the beams 108 causing the beams 108 to bend radially inward. The further the locking member 124 extends from the inner surface of the mating body 122 the greater the bend that may be induced on the beams 108 during positioning of the beams 108 in the inner area of the mating body 122. The snap value of the collet device 100 can be adjusted by changing the amount that the locking member 124 extends from the inner surface of the mating body 122.

Although the collet device 100 is depicted as positioned in an inner area of mating device 120, the collet device 100 can be positioned such that beams 108 grip an exterior surface of a mating body. In some examples, a force applied by the beams can be an inwardly radial force that can grip the exterior surface of a mating device. In additional or alternative aspects, a locking member can be positioned to extend from an outer surface of a mating device. Although the collet device 100 and mating device 120 are depicted as cylindrical and the main body 102, inner member 104, outer member 106, and locking member 124 are each depicted as ring-shaped, they may be any suitable shape. For example, a collet device can be a rectangular prism with a channel along a longitudinal axis.

Figure 2:
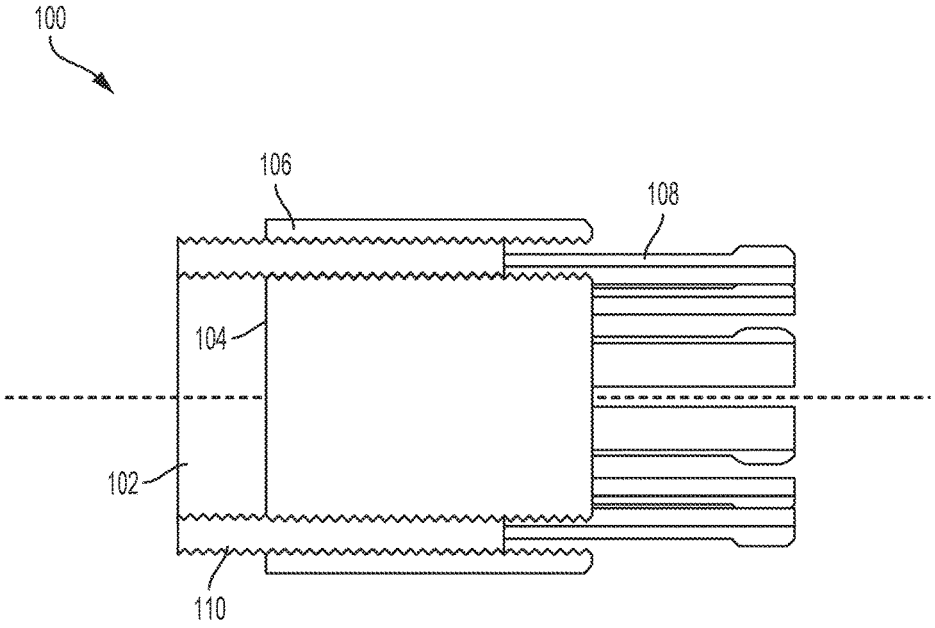
FIG. 2 is a cross-sectional diagram of an example of a collet device having an inner member and an outer member threadably coupled to a main body of the collet device according to one aspect of the present disclosure.

FIG. 2 is a cross-sectional diagram of an example of the collet device 100 from FIG. 1 having the inner member 104 and the outer member 106 threadably coupled to the main body 102 with threads 110. The inner member 104 can be radially adjacent to an inner surface of the main body 102. The outer surface of the inner member 104 and the inner surface of the main body 102 can have threads 110 for threadably coupling the inner member 104 to the main body 102. The inner member 104 can move axially along the inner surface of the main body 102 and a portion of the inner surface of the beams 108.

The outer member 106 can be radially adjacent to an outer surface of the main body 102. The inner surface of outer member 106 and the outer surface of the main body 102 can have threads 110 for threadably coupling the outer member 106 to the main body 102. The outer member 106 can move axially along the outer surface of the main body 102 and a portion of the outer surface of the beams 108.

The threads can be spiraled such that rotating the inner member 104 or the outer member 106 can axially move the inner member 104 or the outer member 106. The inner member 104 and the outer member 106 can be positioned to encompass a section of the beams 108 such that the section of the beams 108 is within the tubular body. The portion of the beams 108 that extends from the tubular body can bend at a seam between the beams 108 and the tubular body. In some examples, the shorter the portion of the beams that extends from the tubular body the greater the force required to bend the portion of the beams. The snap value can be based on a magnitude of force required to bend the portion of the beams 108, so moving the inner member 104 and the outer member 106 toward an end of the beams 108 can increase the snap value and moving the inner member 104 and the outer member 106 away from an end of the beams 108 can decrease the snap value.

Although the threads 110 in FIG. 2 are depicted as extending across an entire surface of main body 102, inner member 104, and outer member 106, threads may cover only a portion of the surface of the main body 102, inner member 104, and outer member 106. In some aspects, threads may cover a portion of a surface of the beams 108. In some aspects, the inner member 104 or the outer member 106 may be threadably coupled to the beams 108. The threads for threadably coupling the inner member 104 or the outer member 106 to the main body 102 can be any size. A tighter thread may offer greater precision in axially positioning the inner member 104 or outer member 106.

Figure 3:
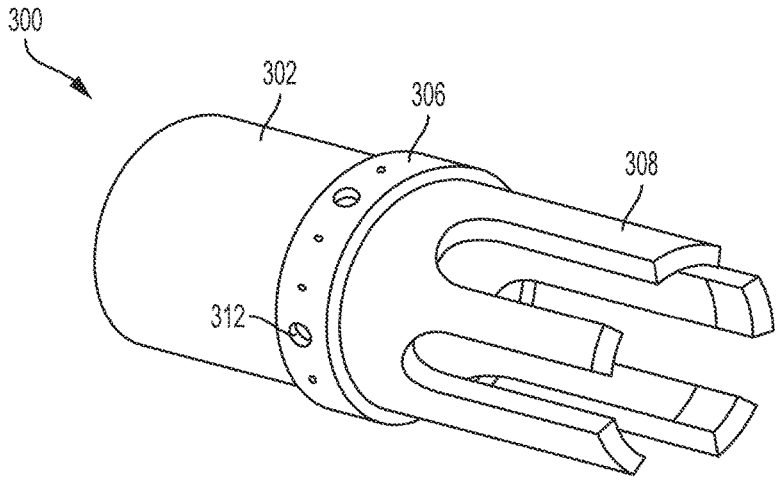
FIG. 3 is a perspective view of an example of a collet device having an outer member that can slide along an exterior surface of a main body of the collet device according to one aspect of the present disclosure
Figure 4:
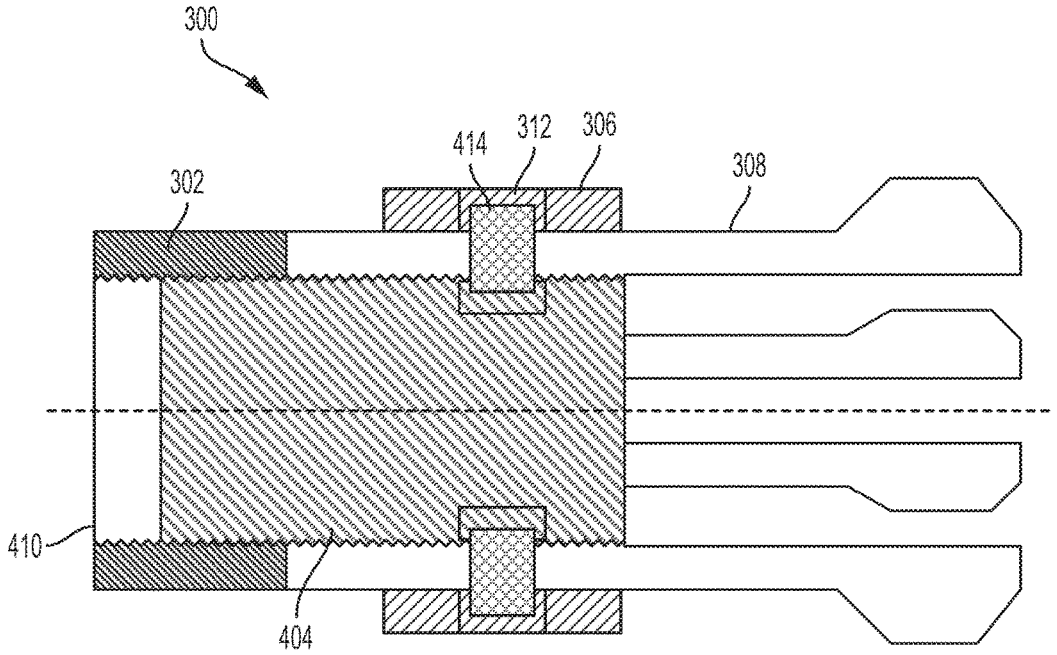
FIG. 4 is a cross-sectional diagram of an example of the collet device in FIG. 3 having a fastener for locking the outer member at an axial position according to one aspect of the present disclosure.
Figure 5:
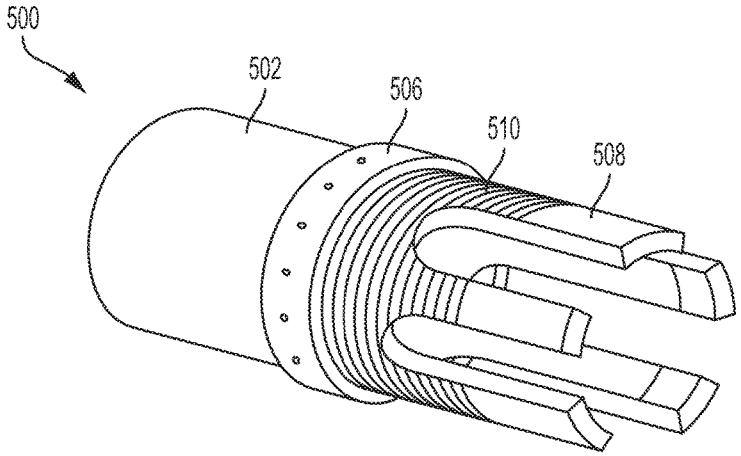
FIG. 5 is a perspective view of an example of a collet device having an outer member threadably coupled to the main body according to one aspect of the present disclosure.

FIGS. 3-4 are a perspective view and a cross-sectional view of an example of a collet device 300 with a tubular body having a main body 302 and an outer member 306 that can slide along an external surface of the main body 302. The outer member 306 can include openings 312 positioned through the outer member 306. Beams 308 can be coupled to the main body 302 and extend radially from the tubular body.

The collet device 300 in FIG. 4 depicts the tubular body with an inner member 404 threadably coupled to main body 302 by threads 410. FIG. 4 also depicts fasteners 414 that can be positioned in the openings 312. In some examples, the fastener 414 can be a lug or a screw and can lock the outer member 306 and inner member 404 at an axial position. The inner member 404 can be positioned axially, relative to the main body 302, by rotating the inner member 404 within threads 410. The outer member 306 can slide to a position relative to the main body 302. The fastener can be positioned in the opening 312 such that the fastener extends through a gap between two beams 308 and couples to the inner member 404. The fastener 414 can lock the outer member 306 into alignment with inner member 404. The fastener 414 can also limit the axial movement of the inner member 404 by preventing the inner member 404 from rotating due to the fastener 414 being positioned in the gap between two beams 308. In some examples, the fastener may contact a beam 308 on each side of the gap such that the inner member 404 is locked from moving axially.

A section of beams 308 can be positioned between outer member 306 and inner member 404 such that a portion of the beams 308 that extends from the tubular body is shorter than a full length of the beams 308. The snap value for collet device 300 can be adjusted by moving the inner member 404 and outer member 306 to change the length of the portion of the beams 308 that extend from the tubular body.

In some aspects, an outer member can have a number of openings equal to the number of beams 308 coupled to the main body 302 such that each opening can be aligned with a gap between the beams to create a passage between an area external to the outer member and an inner area of the main body. In some additional or alternative aspects, an application of a collet device can have space constraints. Collet device 300 can have a smaller outer diameter than a collet device that has a layer of threads between an outer member and a main body. Outer member 306 and main body 302 can be thinner than a threaded outer member and a threaded main body. Although not illustrated in FIGS. 3-4, a beam can include an aperture therethrough and the fastener 414 can be positioned to pass through an opening in the outer member 306 and an aperture in the beam.

FIGS. 5-8 are a perspective view and cross-sectional views, respectively, of a collet device 500 with a tubular body. The tubular body having a main body 502 and an outer member 506 threadably coupled to the main body 502 by threads 510. The collet device 500 also includes beams 508 coupled to the main body 502 and extending axially from the tubular body.

Although not illustrated in FIG. 5, FIGS. 6-8 depict the collet device 500 with an inner member 604. The inner member 604 can be a mandrel that is positioned radially adjacent to an inner surface of the main body 502. The inner member 604 can have an outer diameter that is larger than the inner diameter of the beams 508 such that positioning the mandrel radially adjacent to the beams 508 applies a force to the beams 508 causing the beams 508 to bend radially outward.

Figure 6:
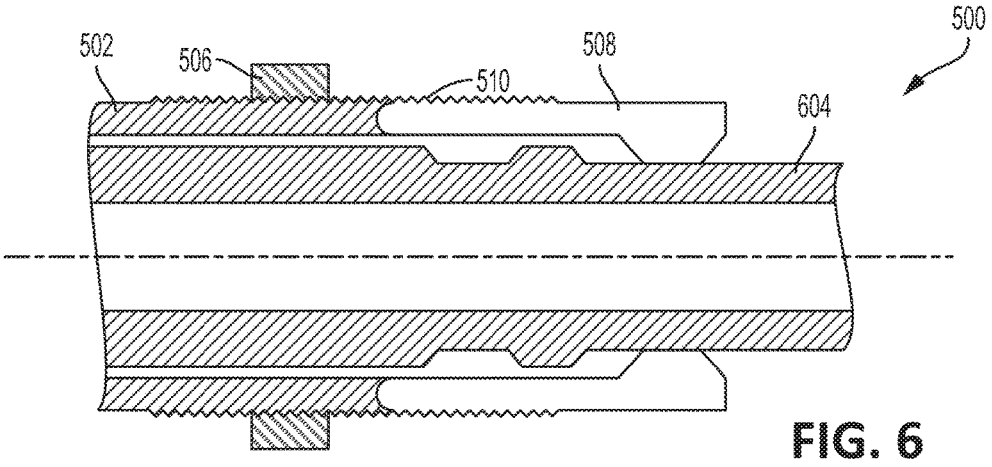
FIG. 6 is a cross-sectional view of an example of the collet device in FIG. 5 having a mandrel passing through an inner area of the collet device according to one aspect of the present disclosure.
Figure 7:
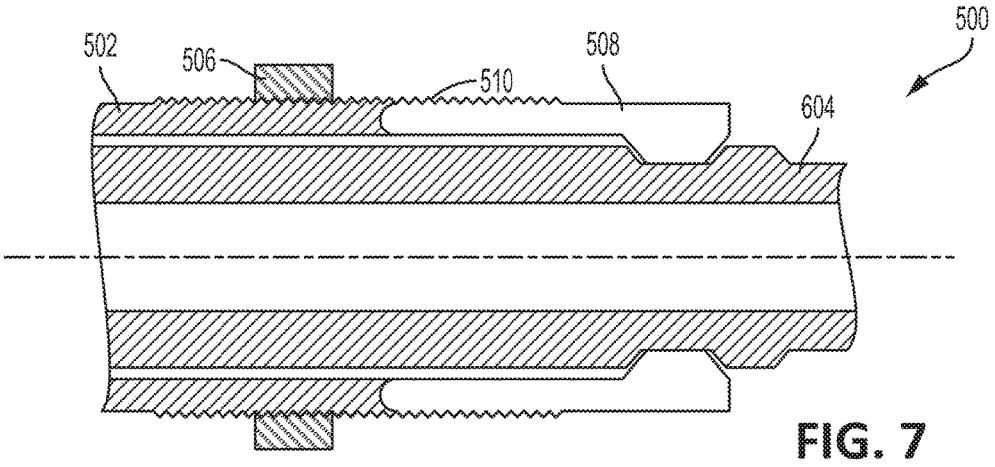
FIG. 7 is a cross-sectional view of an example of the collet device in FIG. 5 having a mandrel in a locked position in an inner area of the collet device according to one aspect of the present disclosure.
Figure 8:
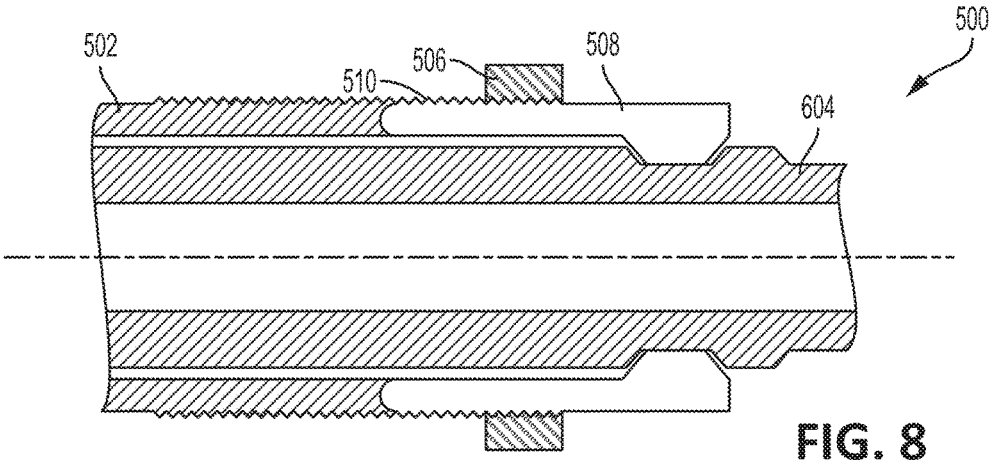
FIG. 8 is a cross-sectional view of an example of the collet device in FIG. 5 having a mandrel in a locked position in an inner area of the collet device and the outer member at a second position for increasing a snap value according to one aspect of the present disclosure.

FIG. 6 is a cross-sectional example of the collet device 500 with the inner member 604 in an unlocked position such that it can move axially. FIGS. 7-8 are cross-sectional examples of the collet device 500 with the inner member 604 in a locked position. In FIG. 7, the outer member 606 is positioned radially adjacent to the main body 502 such that the tubular body does not encompass any section of the beams 508. A length of a portion of the beams 508 that extends from the tubular body can be a full length of the beams 508. In FIG. 8, the outer member 506 is positioned radially adjacent to the beams 508 such that only a portion of beams 508 extends from the tubular body. The snap value of collet 500 in FIG. 8 can be higher than the snap value of collet 500 in FIG. 7 because of the positioning of outer member 506.

Figure 9:
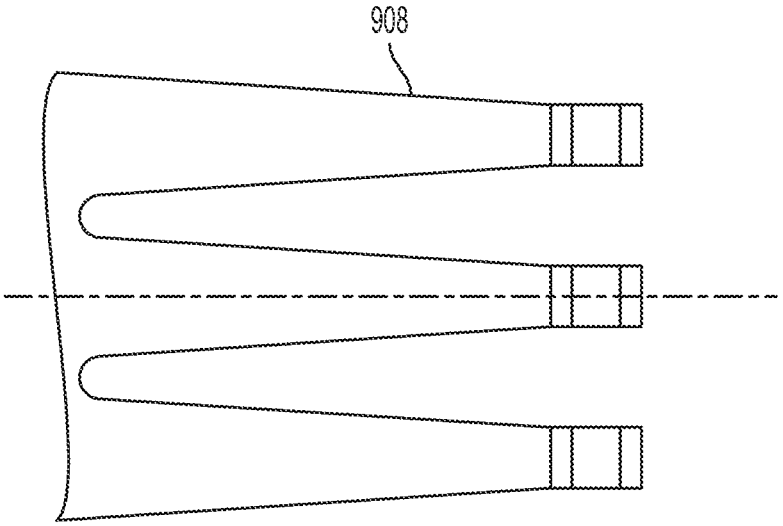
FIG. 9 is a cross-sectional view of tapered beams according to one aspect of the present disclosure.
Figure 10:
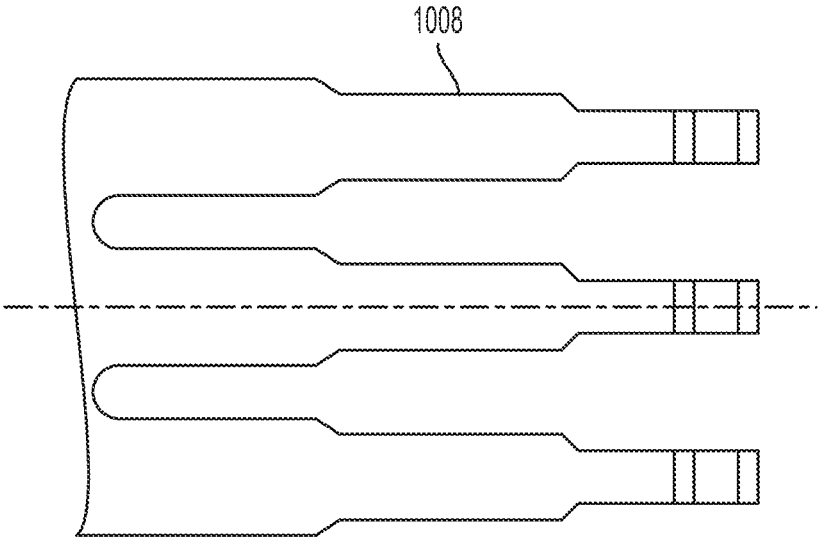
FIG. 10 is a cross-sectional view of stepped beams according to one aspect of the present disclosure.

FIGS. 9-10 are cross-sectional views of examples of beams 908, 1008 with a non-uniform cross-sectional area. In some aspects, a snap value associated with a collet device can be based on a cross-sectional area of the beams 908, 1008 at a seam where a portion of the beams 908, 1008 extend from a tubular body of the collet device. In some examples, a beam with a larger cross-sectional area at the seam can require a greater force to bend than a beam with a smaller cross-sectional area at the seam. An inner member or an outer member of the tubular body can be positioned axially to adjust a location of the seam, which can change the cross-sectional area of the beam 908, 1008 at the seam.

In FIG. 9, the beams 908 are tapered such that beams 908 have a linearly smaller cross-sectional area at points farther from the tubular body. As an inner member and outer member of a tubular body are moved toward the portion of the beams that extends from the tubular body, the seam is moves and can be positioned at a portion of the beams 908 with a smaller cross-sectional area. In FIG. 10, beams 1008 are stepped such that a cross-sectional area has a non-linear decrease at points farther from the tubular body. The cross-sectional area of beams 1008 can decrease across some segments of the beams 1008 and the cross-sectional area of the beams 1008 can remain constant in other segments.

In some aspects, a width of a beam may be non-uniform. In additional or alternative aspects, a thickness of a beam may be non-uniform. A collet device with a beam that has a non-uniform cross-sectional area can have a larger range of snap values than a collet device with beams that have a uniform cross-sectional area. In some examples, a change in a length of a portion of a beam that extends from a tubular body of a collet device with a non-uniform cross-sectional area can have an exponential change in snap value. Although FIGS. 9-10 depict beams with cross-sectional areas that decrease at points farther from a tubular body, some collet devices can have beams that have an increase in cross-sectional area at points farther from a tubular body.

Figure 11:
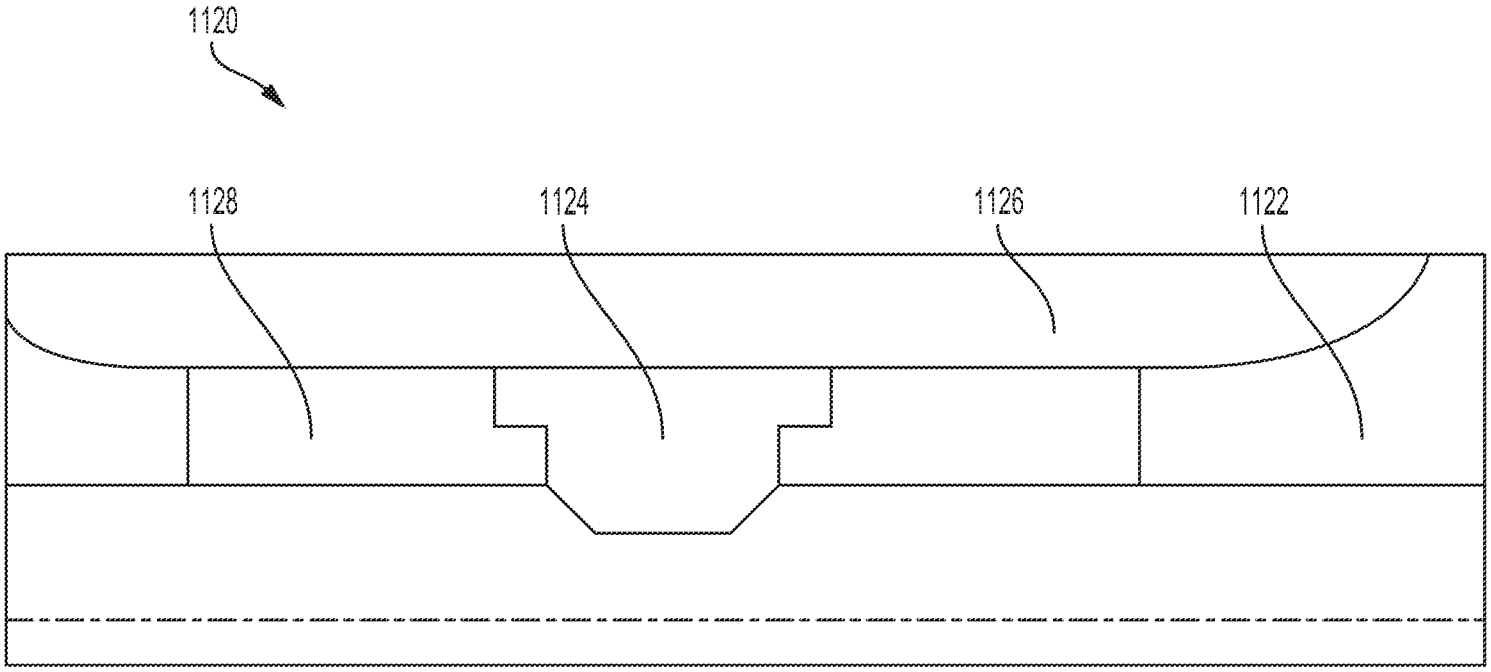
FIG. 11 is a cross-sectional view of an example of a mating device having a locking member that can be replaced for adjusting an inner diameter of a segment of the mating device according to one aspect of the present disclosure.

FIG. 11 is a cross-sectional view of an example of a mating device 1120 having a locking member 1124 that can be replaced for adjusting an inner diameter of the mating body 1122. The mating body 1122 can include an outer layer 1126, a retaining layer 1128 and the locking member 1124. The retaining layer 1128 can be coupled to the mating body 1122 such that a groove forms in an inner surface of the mating body 1122. The locking member 1124 can be positioned in the groove such that the locking member 1124 extends into an inner area of the mating body 1122. The outer layer 1126 can be positioned radially adjacent to the retaining layer 1128 and locking member 1124 such that the locking member 1124 is trapped in the groove.

The locking member 1124 can form the smallest inner diameter of the mating body 1122 and can contact a collet device (not illustrated) that can be positioned in the inner area. In some examples, the further the locking member 1124 extends from the inner surface of the mating body 1122 the smaller the inner diameter of the mating body 1122 and the greater a snap value of the collet device. In some aspects, the outer layer 1126 can be decoupled from the mating body 1122 such that the locking member 1124 can be removed from the mating device 1120 and replaced with a locking member of a different size. Replacing the locking member 1124 of the mating device 1120 can adjust the snap value for a collet device coupled to the mating device 1120.

Although FIG. 11 depicts the locking member 1124 as extending into an inner area of the mating body 1122, a mating device can have a locking member for extending from an outer surface of the mating device. In some aspects, the outer layer can be threadably coupled to the mating body.

Figure 12:
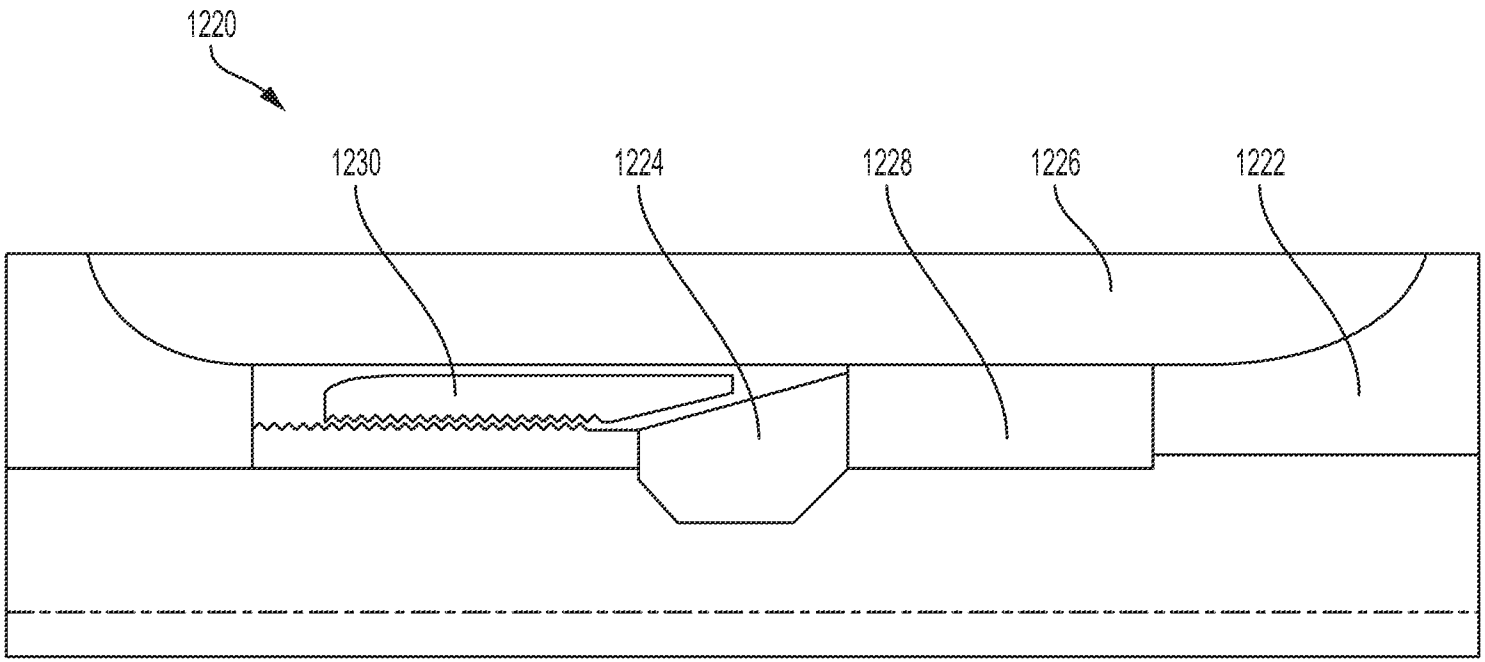
FIG. 12 is a cross-sectional view of an example of a mating device having a wedge for adjusting an amount that a locking member extends from an inner surface of the mating device according to one aspect of the present disclosure.

FIG. 12 is a cross-sectional view of an example of a mating device 1220 having a wedge 1230 for changing an amount that a locking member 1224 extends from an inner surface of the mating device 1222 for adjusting an inner diameter of the mating body 1222. The mating body 1222 can include an outer layer 1226, a retaining layer 1228, the locking member 1224, and the wedge 1230. The retaining layer 1228 can be coupled to the mating body 1222 such that a groove exists in the inner surface of the mating body 1222. The locking member 1224 can be positioned in the groove such that the locking member 1224 extends into an inner area of the mating body 1222. The wedge 1230 can be positioned axially adjacent to the locking member 1224 relative to the mating body 1222 and can be threadably coupled to the retaining layer 1228. The wedge can include an edge that can contact the locking member 1124 such that moving the wedge axially can change the amount that the locking member 1224 extends from the inner surface of the mating body 1222. The outer layer 1226 can be positioned radially adjacent to the retaining layer 1228, locking member 1224, and wedge 1230 such that the locking member 1224 is trapped in the groove and the wedge 1230 is locked axially.

The locking member 1224 can form the smallest inner diameter of the mating body 1222 and can contact a collet device (not illustrated) that can be positioned in the inner area. The further the locking member 1224 extends from the inner surface of the mating body 1222 the smaller the inner diameter of the mating body 1222 and the greater a snap value of the collet device. In some aspects, the outer layer 1226 can be decoupled from the mating body 1222 such that the wedge 1230 can move axially to adjust the amount that the locking member extends into the inner area of the mating body 1222. In additional or alternative aspects, a wedge may extend through an opening in the mating body 1222, or an opening in the mating body 1222 may allow access to the wedge for moving the wedge axially.

Although FIG. 12 depicts the locking member 1224 as extending into an inner area of the mating body 1222, a mating device can have a locking member for extending from an outer surface of the mating device. In some aspects, a locking member can be threadably coupled to the retaining layer 1228 such that the locking member can be rotated to adjust an amount that the locking member extends from the inner surface of the mating body 1222.

In some aspects, a collet device with an adjustable snap value is provided according to one or more of the following examples:

Example #1

A first device can include a tubular body and beams. The tubular body can include a main body, an inner member, and an outer member. The inner member can be in an inner area of the main body and can be axially moved relative to the main body. The outer member can be in an outer area of the main body and can be axially moved relative to the main body. The beams can be coupled to the main body. A portion of the beams can extend axially from an end of the tubular body. A length of the portion of the beams that extend axially from the end of the tubular body can be adjusted by moving the inner member or the outer member. Adjusting the length of the portion can change a snap value corresponding to a magnitude of a force that can be exerted by the beams in a direction of a second device positioned radially adjacent to the beams.

Example #2

The first device of Example #1, further featuring the inner member being threadably coupled to the main body or the beams.

Example #3

The first device of Example #2, further featuring the outer member can axially slide along an exterior surface of the main body. The outer member can include an opening therethrough. A fastener can be positioned through the opening and through a gap between beams for coupling the outer member to the inner member and locking the outer member at a position axially.

Example #4

The first device of Example #1, further featuring the outer member can be threadably coupled to the main body or the beams.

Example #5

The first device of Example #4, further featuring the inner member can be a mandrel for applying an outwardly radial force to the beams based on the mandrel having an outer diameter larger than an inner diameter of the beams.

Example #6

The first device of Example #1, further featuring at least one beam including a non-uniform cross-sectional area such that at least one of the inner member or the outer member can be moved to adjust a cross-sectional area of the portion of the beams extending axially from the end of the tubular body at a seam between the portion of the beams extending axially from the end of the tubular body and the tubular body.

Example #7

The first device of Example #6, further featuring the at least one beam has a tapered width such that a first portion has a larger cross-sectional area than a second portion and the first portion is closer to the main body than the second portion.

Example #8

The first device of Example #1, further featuring the main body can be cylindrical and the inner member and the outer member can each be ring-shaped.

Example #9

The first device of Example #1, further featuring the beams can be for exerting the force in an outwardly radial direction to couple to the second device by gripping an inner surface of the second device.

Example #10

The first device of Example #1, further featuring the beams can be for exerting the force in an inwardly radial direction to couple to the second device by gripping an exterior surface of the second device.

Example #11

A first device including a mating body and a locking member. The mating body can be positioned radially adjacent to a second device. The locking member can extend from the mating body for contacting the second device. The amount that the locking member extends from the mating body can be adjusted to change a snap value corresponding to a magnitude of a force that can be exerted for coupling the first device to the second device.

Example #12

The first device of Example #11, further including a wedge positioned between an inner surface and an outer surface of the mating body. The wedge can be axially moved to contact the locking member for adjusting the amount that the locking member extends from the mating body.

Example #13

The first device of Example #11, further featuring the mating body can be cylindrical and the locking member can be ring-shaped.

Example #14

The first device of Example #11, further featuring a section of the mating body that includes a retaining sleeve for retaining the locking member in a groove. The locking member can be a first locking member and can be replaced with a second locking member for adjusting the amount of the locking member that extends from the mating body.

Example #15

An assembly can include a first device and a second device. The first device can include a tubular body and beams. The tubular body can include a main body, an inner member, and an outer member. The inner member can be an inner area of the main body that can be axially moved relative to the main body. The outer member can be in an outer area of the main body that can be axially moved relative to the main body. The beams can be coupled to the main body. A portion of the beams can extend axially from an end of the tubular body. A length of the portion of the beams extending axially from the end of the tubular body can be adjusted by moving the inner member or the outer member. The second device can include a mating body and a locking member. The mating body can be positioned radially adjacent to the beams. The locking member can extend from the mating body for contacting the beams. An amount that the locking member extends from the mating body can be adjusted to change a snap value corresponding to a magnitude of a force that can be exerted by the beams in a direction of the second device based on the length of the portion of the beams extending axially from the end of the tubular body.

Example #16

The assembly of Example #15, further featuring the beams can be for exerting the force in an outwardly radial direction to couple the first device to the second device by gripping an inner surface of the mating body. The locking member can extend from the inner surface.

Example #17

The assembly of Example #15, further featuring the beams can be for exerting the force in an inwardly radial direction to couple the first device to the second device by gripping an exterior surface of the second device. The locking member can extend from an outer surface of the first device.

Example #18

The assembly of Example #15, further featuring the inner member and the outer member can each be threadably coupled to the main body or the beams. At least one beam can include a non-uniform cross-sectional area such that at least one of the inner member or the outer member can be moved to adjust a cross-sectional area of the portion of the beams extending axially from the end of the tubular body.

Example #19

The assembly of Example #15, further including a wedge that can be positioned between an inner surface and an outer surface of the mating body. The wedge can be axially moved to contact the locking member for adjusting the amount that the locking member extends from the mating body.

Example #20

The assembly of Example #15, further featuring the main body and the mating body can each be cylindrical and the inner member, the outer member, and the locking member can each be ring-shaped.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A first device comprising:

a tubular body comprising:

a main body;

an inner member in an inner area of the main body that is axially moveable relative to the main body; and an outer member in an outer area of the main body that is axially moveable relative to the main body, wherein the outer member comprises an opening therethrough; and a plurality of beams coupled to the main body, a portion of the plurality of beams extending axially from an end of the tubular body, a length of the portion of the plurality of beams extending axially from the end of the tubular body being adjustable by moving the inner member or the outer member for changing a snap value corresponding to a magnitude of a force exertable by the plurality of beams in a direction of a second device positionable radially adjacent to the plurality of beams;

wherein a fastener is positionable through the opening and through a gap between beams of the plurality of beams for coupling the outer member to the inner member and locking the outer member at a position axially.

2. The first device of claim 1, wherein the inner member is threadably coupled to the main body or the plurality of beams.

3. The first device of claim 2, wherein the outer member is axially slideable along an exterior surface of the main body.

4. The first device of claim 1, wherein the outer member is threadably coupled to the main body or the plurality of beams.

5. The first device of claim 4, wherein the inner member is a mandrel for applying an outwardly radial force to the plurality of beams based on the mandrel having an outer diameter larger than an inner diameter of the plurality of beams.

6. The first device of claim 1, wherein at least one beam of the plurality of beams comprises a non-uniform cross-sectional area such that at least one of the inner member or the outer member are movable to adjust a cross-sectional area of the portion of the plurality of beams extending axially from the end of the tubular body at a seam between the portion of the plurality of beams extending axially from the end of the tubular body and the tubular body.

7. The first device of claim 6, wherein the at least one beam has a tapered width such that a first portion has a larger cross-sectional area than a second portion and the first portion is closer to the main body than the second portion.

8. The first device of claim 1, wherein the main body is cylindrical and the inner member and the outer member are each ring-shaped.

9. The first device of claim 1, wherein the plurality of beams are for exerting the force in an outwardly radial direction to couple to the second device by gripping an inner surface of the second device.

10. The first device of claim 1, wherein the plurality of beams are for exerting the force in an inwardly radial direction to couple to the second device by gripping an exterior surface of the second device.

11. A first device comprising: a mating body positioned radially adjacent to a second device; and a locking member extending from the mating body contacting a plurality of beams in the second device, an amount that the locking member extends from the mating body being adjustable to change a snap value corresponding to a magnitude of a force exertable by the plurality of beams in a direction of the second device based on the length of the portion of the plurality of beams extending axially from the end of a tubular body of the second device for coupling the first device to the second device.

12. The first device of claim 11, further comprising:

a wedge positionable between an inner surface and an outer surface of the mating body, wherein the wedge is axially moveable to contact the locking member for adjusting the amount that the locking member extends from the mating body.

13. The first device of claim 11, wherein the mating body is cylindrical and the locking member is ring-shaped.

14. The first device of claim 11, wherein a section of the mating body comprises a retaining sleeve for retaining the locking member in a groove, wherein the locking member is a first locking member and is replaceable with a second locking member for adjusting the amount of the locking member that extends from the mating body.

15. An assembly comprising:

a first device comprising:

a tubular body comprising:

a main body;

an inner member in an inner area of the main body that is axially moveable relative to the main body; and an outer member in an outer area of the main body that is axially moveable relative to the main body; and a plurality of beams coupled to the main body, a portion of the plurality of beams extending axially from an end of the tubular body, a length of the portion of the plurality of beams extending axially from the end of the tubular body being adjustable by moving the inner member or the outer member; and a second device comprising:

a mating body positionable radially adjacent to the plurality of beams; and a locking member extending from the mating body for contacting the plurality of beams, an amount that the locking member extends from the mating body being adjustable to change a snap value corresponding to a magnitude of a force exertable by the plurality of beams in a direction of the second device based on the length of the portion of the plurality of beams extending axially from the end of the tubular body.

16. The assembly of claim 15, wherein the plurality of beams are for exerting the force in an outwardly radial direction to couple the first device to the second device by gripping an inner surface of the mating body, wherein the locking member extends from the inner surface.

17. The assembly of claim 15, wherein the plurality of beams are for exerting the force in an inwardly radial direction to couple the first device to the second device by gripping an exterior surface of the second device, wherein the locking member extends from an outer surface of the first device.

18. The assembly of claim 15, wherein the inner member and the outer member are each threadably coupled to the main body or the plurality of beams, wherein at least one beam of the plurality of beams comprises a non-uniform cross-sectional area such that at least one of the inner member or the outer member are movable to adjust a cross-sectional area of the portion of the plurality of beams extending axially from the end of the tubular body.

19. The assembly of claim 15, further comprising:

a wedge positionable between an inner surface and an outer surface of the mating body, wherein the wedge is axially moveable to contact the locking member for adjusting the amount that the locking member extends from the mating body.

20. The assembly of claim 15 wherein the main body and the mating body are each cylindrical and the inner member, the outer member, and the locking member are each ring-shaped.

* * * * *